United States Patent [19]

McNally

[11] Patent Number: 4,831,790

[45] Date of Patent: May 23, 1989

[54] ABRASIVE JET BLASTING MACHINE FOR A CONTINUOUS ABRASIVE JET BLASTING TREATMENT OF WIRE-SHAPED AND ROD-SHAPED WORKPIECES

[75] Inventor: Terence McNally, Schaffhausen, Switzerland

[73] Assignee: Georg Fischer AG, Schaffhausen, Switzerland

[21] Appl. No.: 114,307

[22] Filed: Oct. 27, 1987

[30] Foreign Application Priority Data

Nov. 3, 1986 [CH] Switzerland ..... 04349/86

[51] Int. Cl.[4] ..... B24C 3/00; B24B 49/00

[52] U.S. Cl. ..... 51/410; 51/165.74

[58] Field of Search ..... 51/410, 165.74, 165.75, 51/237 R

[56] References Cited

U.S. PATENT DOCUMENTS 4,662,125 5/1987 Brenner et al. ..... 51/237 R

FOREIGN PATENT DOCUMENTS 1954271 7/1972 Fed. Rep. of Germany .

1815187 10/1975 Fed. Rep. of Germany .

*Primary Examiner*—John K. Corbin

*Assistant Examiner*—J. Ryan

*Attorney, Agent, or Firm*—Toren, McGeady & Associates

[57] ABSTRACT

An abrasive jet blasting machine for a continuous abrasive jet blasting treatment of wire-shaped and rod-shaped workpieces includes a plurality of centrifugal wheel units arranged angularly offset relative to each other. To each centrifugal wheel unit are assigned two jet conducting and guiding plates which are adjustable relative to each other. All jet guiding plates are adjustable jointly either toward or away from the workpiece by means of an adjusting device which includes a swivelable lever. The adjusting device includes a sensing device which is directed toward the workpiece and is adjustable in the same sense as the jet guiding plates. The sensing device is in operative connection with an adjusting drive which acts on the lever of the adjusting device.

8 Claims, 1 Drawing Sheet

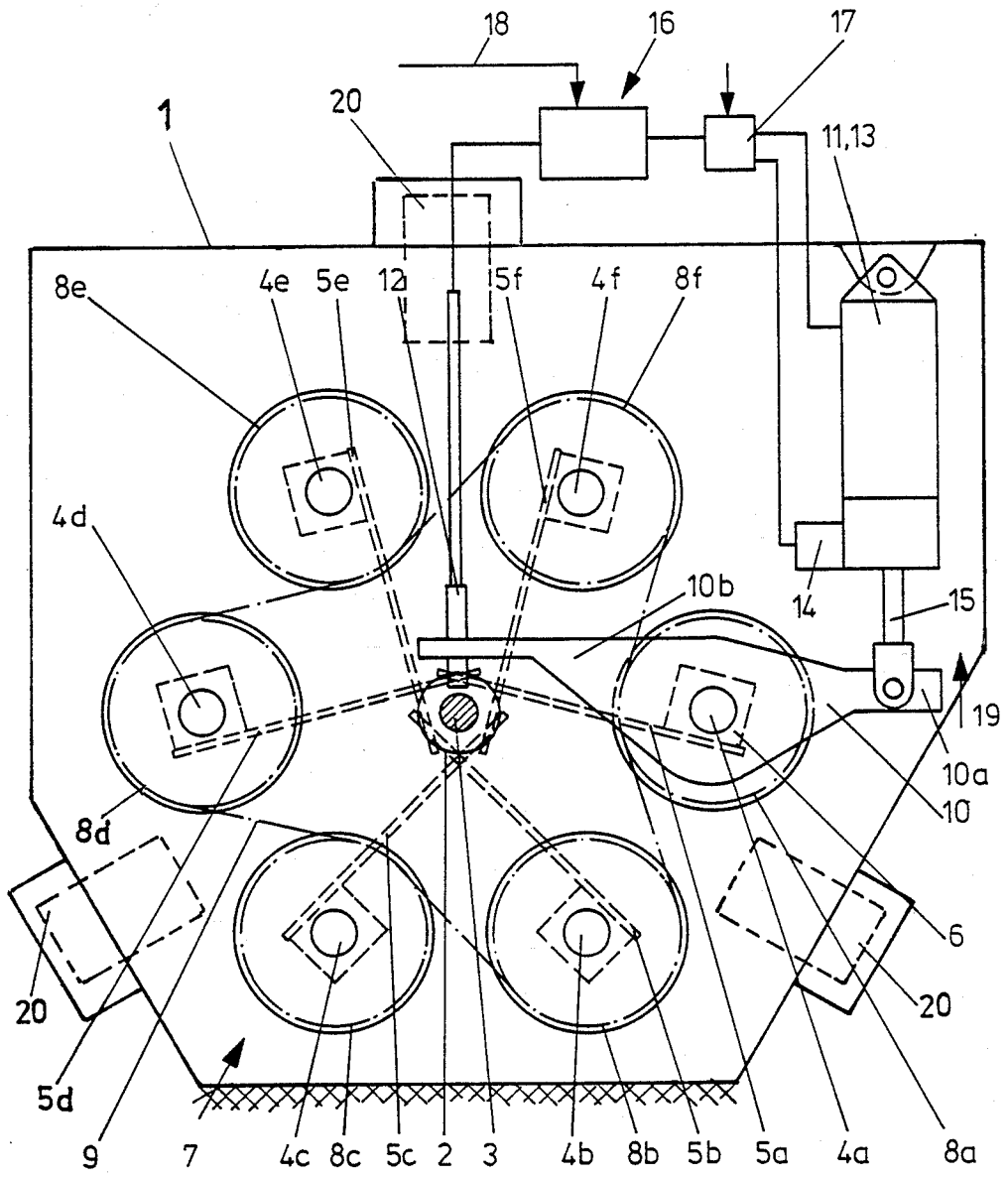
18
16
17
1
20
11,13
8e
4e
5e
12
5f
4f
8f
4d
10b
14
15
19
10a
10
8d
6
20
20
5d
9
7
4c
8c
5c
2
3
4b
8b
5b
5a
4a
8a

ABRASIVE JET BLASTING MACHINE FOR A CONTINUOUS ABRASIVE JET BLASTING TREATMENT OF WIRE-SHAPED AND ROD-SHAPED WORKPIECES

BACKGROUND OF THE INVENTION

1. Field of the Invention

The present invention relates to an abrasive jet blasting machine for a continuous abrasive jet blasting treatment of wire-shaped and rod-shaped workpieces. The abrasive jet blasting machine includes a plurality of centrifugal wheel units arranged angularly offset relative to each other. To each centrifugal wheel unit are assigned two jet conducting and guiding plates which are adjustable relative to each other. All jet guiding plates are adjustable jointly either toward or away from the workpiece by means of an adjusting device which includes a swivelable lever.

2. Description of the Prior Art

An abrasive jet blasting machine of the above-described type is known from DE-C3-1,815,187. In this machine, each pair of jet guiding plates assigned to a centrifugal wheel is separately manually adjustable in accordance with the respective dimension of the workpiece by means of an adjusting device which includes a threaded spindle.

DE-C2-1,954,271 discloses a further development of the abrasive jet blasting machine mentioned above. In this machine, all jet guiding plate pairs are jointly manually adjustable by means of an adjusting device. The jet guiding plates must be adjusted on the basis of a scale each time workpieces with different cross-sectional dimensions or diameters are treated. This is very time-consuming. In addition, when the adjustment is carried out incorrectly, the machine or the workpieces may be damaged.

It is, therefore, the primary object of the present invention to provide an abrasive jet blasting machine of the above-described type in which an automatic adjustment of the jet guiding plates in accordance with the cross-section of the workpiece is ensured when a change of the dimension of the workpiece occurs.

SUMMARY OF THE INVENTION

In accordance with the present invention, the adjusting device of the abrasive jet blasting machine of the above-described type includes a sensing device which is directed toward the workpiece and is adjustable in the same sense as the jet guiding plates. The sensing device is in operative connection with an adjusting drive which acts on the lever of the adjusting device.

In the abrasive jet blasting machine according to the present invention, the jet conducting and guiding plates are automatically adjusted dependinng upon the diameter of the workpieces to be subjected to the abrasive jet blasting treatment. Consequently, the abrasive jet blasting machine does not require periods of standstill even when workpieces are exchanged frequently. In addition, incorrect adjustments are avoided.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

BRIEF DESCRIPTION OF THE DRAWING

In the drawing:

The FIGURE of the drawing is a schematic elevational side view of an adjusting device arranged in an abrasive jet blasting machine according the present invention.

DETAILED DESCRIPTION OF THE INVENTION

As illustrated in the FIGURE of the drawing, a jet blasting chamber 1 of an abrasive jet blasting machine has an inlet or outlet opening 2. Shafts 4*a*–4*f* are rotatably mounted on end walls of the jet blasting chamber 1. Shafts 4*a*–4*f* extend axially parallel to the conveying direction of the wire-shaped or rod-shaped workpiece 3. Jet conducting and guiding plates 5*a*–5*f* are adjustably connected to shafts 4*a*–4*f* by means of clamping or locking members 6.

The jet blasting chamber 1 includes centrifugal wheel units 20. The jet conducting and guiding plates 5*a* to 5*f* are arranged relative to the centrifugal wheel units 20 of the abrasive jet blasting machine such that the wire-shaped or rod-shaped workpiece 3 initially comes into contact with plates 5*a* and 5*b*. Subsequently, workpiece 3 reaches plates 5*e* and 5*f* which are arranged offset by 120° relative to plates 5*a* and 5*b*. Finally, the workpiece 3 is conveyed past plates 5*c* and 5*d* which are offset by another 120°.

An adjusting device 7 is arranged on the inlet or outlet side of the jet blasting chamber 1 in such a way that it is located outside of the jet blasting range of the centrifugal wheel units. The adjusting device 7 includes chain wheels 8*a*–8*f* which are mounted so as to rotate on shafts 4*a*–4*f*. A chain 9 connecting the chain wheels 8*a*–8*f* is mounted on successive chain wheels 8*a*–8*f* alternatingly on the side of the chain wheel facing the workpiece 3 and then at the next chain wheel on the side of the chain wheel facing away from the workpiece 3. Consequently, when one of the shafts, for example, shaft 4*a* with chain wheel 8*a*, is rotated, for example, in clockwise direction, the chain wheels 8*c* and 8*e* are rotated in the same direction as the chain wheel 8*a* and chain wheels 8*b*, 8*d* and 8*f* are rotated in the opposite direction.

A double-armed lever 10 is mounted on shaft 4*a* so as to move together with shaft 4*a*. The outer lever arm 10*a* of lever 10 is engaged by an adjusting drive 11. A sensing device 12 extending to a point above workpiece 3 is arranged on the other lever arm 10*b*. Sensing device 12 has the purpose to sense the position of the upper circumferential surface of the workpiece, and thus, the cross-sectional area size of the workpiece. Adjusting drive 11 is preferably a piston-cylinder unit 13 actuated by means of a pressure medium, such as, comprssed air. Piston cylinder unit 13 includes an integrated locking or clamping device 14 for locking position rod 15.

Sensing device 12 is an electric switch, preferably an inductively operating proximity switch, which is operatively connected to piston cylinder unit 13 over a control unit 16 and a solenoid valve 17.

If no workpiece 3 is present in the range of sensing device 12, the latter is at its uppermost initial position and piston rod 15 is fully extended. In this situation, the jet conducting and guiding plates 5*a*–5*f* assume such a position that the pairs of plates 5*a* and 5*b*, 5*c* and 5*d* and 5*e* and 5*f* which belong together respectively include the greatest angle of opening.

When a workpiece is introduced into the abrasive jet blasting machine, a signal "workpiece present" is automatically generated and conducted through a line 18 to control unit 16 and piston rod 15 is moved upwardly in accordance with arrow 19. At the same time, sensing device 12 is moved by the double-armed lever 10 toward the workpiece 3. The sensing device 12 is stopped by means of control unit 16 and solenoid valve 17 when the sensing device 12 has reached a preadjusted distance from the workpiece 3. Simultaneously, piston rod 15 is held in this clamped position. Since all shafts 4*a*–4*f* are operatively connected to each other through chain 9, the swiveling motion of lever 10 results in a rotation of all shafts 4*a*–4*f* in such a way that the jet conducting and guiding plates 5*a*–5*f* are adjusted in accordance with the diameter of the workpiece present in the machine. Since the swivel axis for the sensing device 12 has the same distance from the center of the workpiece as the swivel axes of all jet guiding plates, the sensing device always ensures the correct adjustment of the jet guiding plates.

When a workpiece change is carried out, the sensing device and the jet guiding plates are always initially returned into the outer initial position and the new adjustment is then carried out as described above.

The adjusting drive may also be an electro-mechanical drive, such as, an electric motor, with a threaded spindle. The solenoid valve at the control unit can then be omitted.

In order to avoid vibrations of the workpiece during the sensing operation, a support roller biased, for example, by means of springs, may be arranged on the side of the workpiece opposite the sensing device 12.

While a specific embodiment of the invention has been shown and described in detail to illustrate the application of the inventive principles, it will be understood that the invention may be embodied otherwise without departing from such principles.

I claim:

1. An abrasive jet blasting machine for a continuous abrasive jet blasting treatment of wire-shaped and rod-shaped workpieces, including a plurality of centrifugal units arranged angularly offset relative to each other, two jetguiding plates each assigned to a centrifugal wheel unit, the jet guiding plates being adjustable relative to each other, an adjusting device including a swivelable lever for adjusting all jet guiding plates jointly either toward or away from the workpiece, wherein the improvement comprises that the adjusting device includes a sensing device which is directed towards the workpiece, the adjusting device being adjustable toward the workpiece as the jet guiding plates are adjusted toward the workpiece and being adjustable away from the workpiece as the jet guiding plates are adjusted away from the workpiece, the sensing device being in operative connection with an adjusting drive which acts on the lever of the adjusting device.

2. The abrasive jet blasting machine according to claim 1, wherein the lever is a double-armed lever, the sensing device being arranged on an arm of the double-armed lever extending above the workpiece.

3. The abrasive jet blasting machine according to claim 1, wherein the sensing device is an electric switch which is in operative connection through a control device to an adjusting drive.

4. The abrasive jet blasting machine according to claim 3, wherein the switch is an inductively operating proximity switch.

5. The abrasive jet blasting machine according to claim 3, wherein the adjusting drive is a piston-cylinder unit operated by a pressure medium, and wherein a solenoid valve is connected to the control device.

6. The abrasive jet blasting machine according to claim 5, wherein the adjusting device includes a locking device which automatically operates in accordance with the adjustment movement.

7. The abrasive jet blasting machine according to claim 6, wherein the locking device is arranged directly on the piston-cylinder unit.

8. The abrasive jet blasting machine according to claim 1, wherein a support roller is arranged on the side of the workpiece facing away from the sensing device.

* * * * *